United States Patent [19]

Torres

[11] Patent Number: 4,688,351

[45] Date of Patent: Aug. 25, 1987

[54] SECURITY WINDOW OF THE JALOUSIE VARIETY

[75] Inventor: Aldo A. Torres, Lajas, P.R.

[73] Assignee: Commonwealth of Puerto Rico, San Juan, P.R.

[21] Appl. No.: 910,634

[22] Filed: Sep. 23, 1986

[51] Int. Cl.[4] ..... E05F 17/00

[52] U.S. Cl. ..... 49/74; 49/50

[58] Field of Search ..... 49/50, 74, 51, 64

[56] References Cited

U.S. PATENT DOCUMENTS 3,460,289 8/1969 Toth ..... 49/50

4,481,734 11/1984 Vaida ..... 49/74 X

*Primary Examiner*—Kenneth Downey

*Attorney, Agent, or Firm*—Scrivener and Clarke

[57] ABSTRACT

A conventional frame for a jalousie type window is made secure against passage therethrough by individuals by inserting bars through the openings in the side frame members normally utilized by the jalousie support brackets which are then pivoted on the bars. The ends of the bars where they project through the side frames members of the jalousie frame are rigidly connected as by welding to a respective one of a pair of bars parallel to the outer side of the side frame members. The bar ends extend beyond the second bars for embedment in a masonry surrounding a window opening adapted to receive the frame. The brackets and jalousie slats are controlled in a conventional manner.

5 Claims, 3 Drawing Figures

SECURITY WINDOW OF THE JALOUSIE VARIETY

This invention relates to windows and more particularly to security windows of the jalousie variety.

Jalousie windows or shades conventionally comprise frames of metallic sheet material having end and side frame members each of which is usually of channel configuration including a base panel normal to the plane of the frame and an outwardly extending flange, at least on the front edge of the base panel, parallel to the plane of the frame. The base panels of the side frames members carry pivot supports for brackets which receive the ends of the jalousie slats, and usually all of the brackets on one side of the frame have a pivot connection with a vertically movable adjusting rod operable by a crank-controlled link to adjust simultaneously the angular position of the brackets on that side of the frame, these brackets being connected through the slats to the brackets on the other side of the frame whereby all of the slats are simultaneously adjustable to the same selected angular position by operation of the crank.

Such jalousie windows are notoriously insecure and can be easily breeched from within by a would-be escapee or from without by a would-be intruder and the object of the present invention is to modify conventional jalousie windows so that they are secure against the passage of persons therethrough, even if the slats are totally destroyed by such persons.

In accordance with the invention, a conventional jalousie window is rendered secure by incorporating in the window a rigid steel frame composed of first laterally extending bars equal in number to the number of slats, the ends of each bar passing through the openings, enlarged if necessary, for the bracket pivot supports, the brackets being now pivotally mounted on the bars. The ends of the first bars are rigidly connected, as by welding, outwardly of the frame to a pair of second bars each parallel to the outer side of a respective side frame member, the ends of the first bars extending beyond the second bars for embedment in masonry surrounding the window opening. Except for the bar mountings for the slat bracket pivots, everything else associated with a conventional jalousie, such as the crank control for the slats, need not be changed. When in place, a jalousie window modified in accordance with the invention is substantially identical to a conventional jalousie window except for the presence of the transverse bars, which may be partially or totally obscured, at least from the outside, depending on the opacity of the slats.

Figure 3:
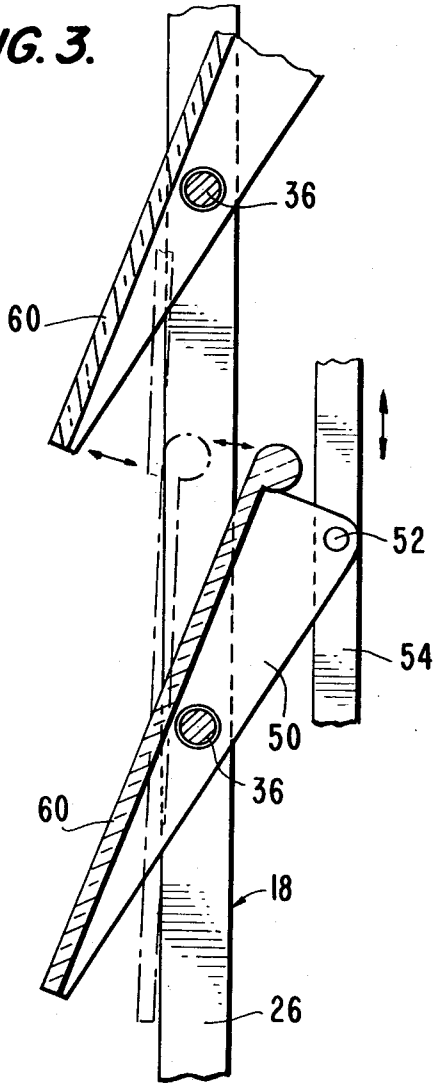
Figure 1:
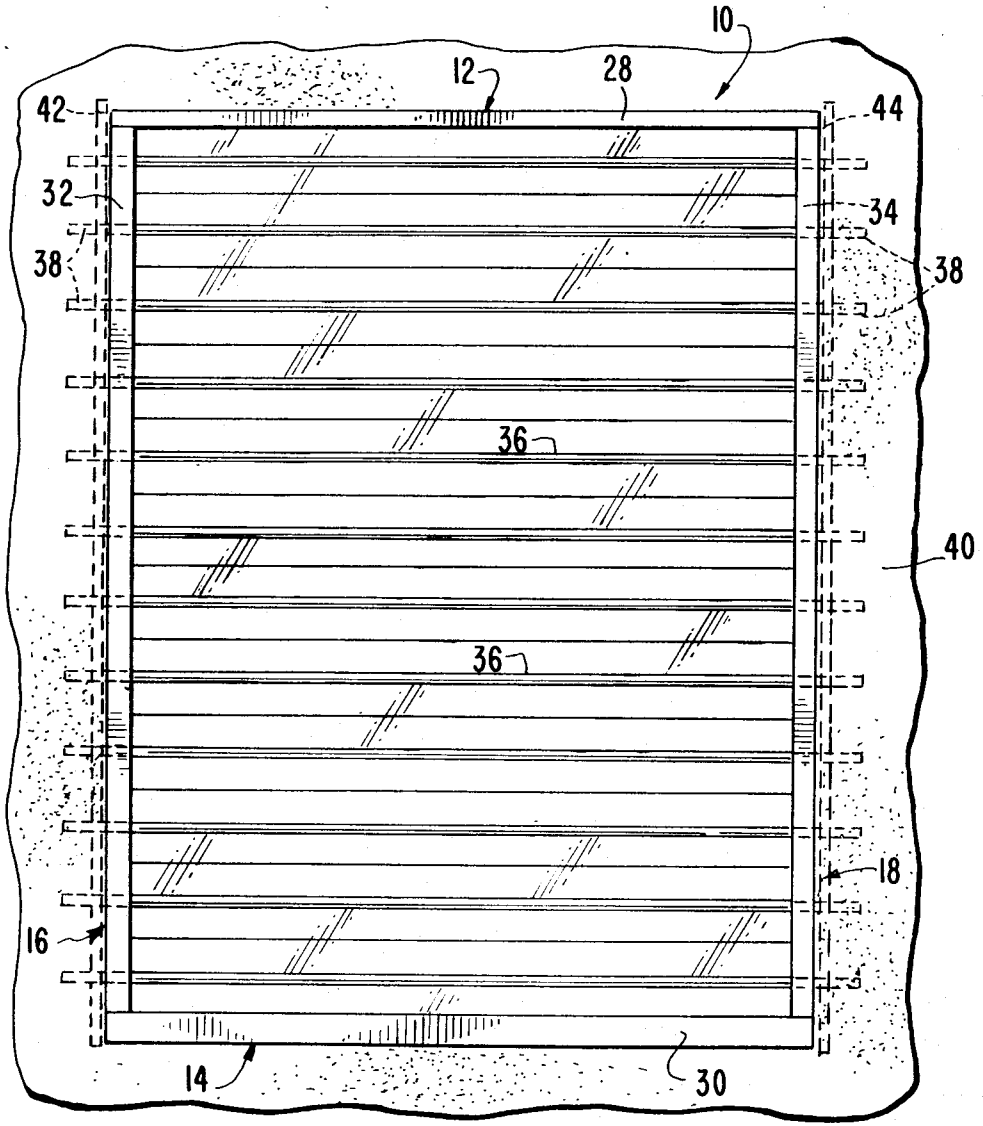
Figure 2:
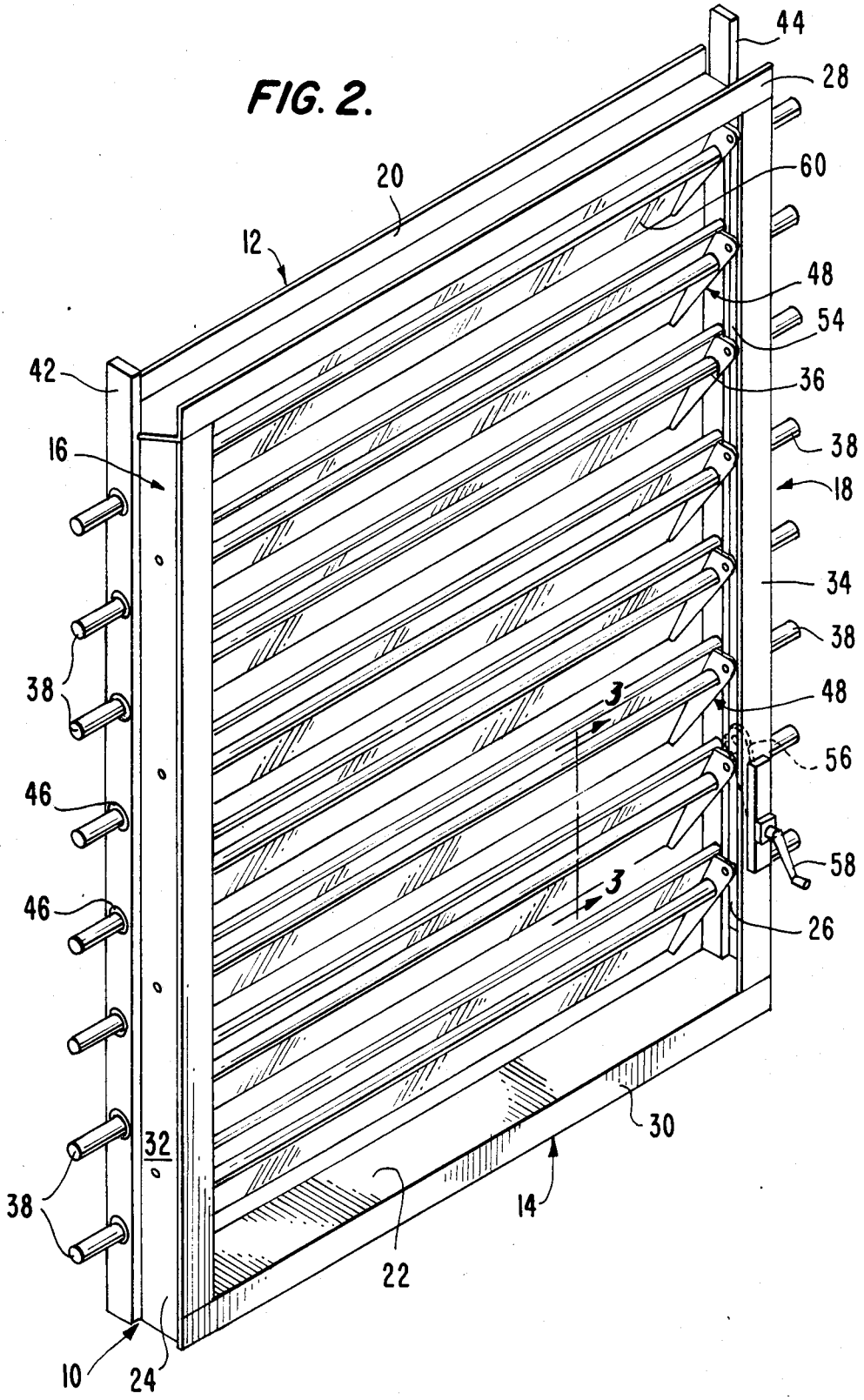

The invention will be more fully understood when the following detailed description is read in conjunction with the accompanying drawings wherein:

FIG. 1 a broken, front elevational view of a building having a window opening in which is mounted a jalousie window modified in accordance with the present invention;

FIG. 2 is a perspective view of the modified jalousie window of FIG. 1; and FIG. 3 is an enlarged, broken detached view taken substantially on the line 3—3 of FIG. 1.

Referring now the drawings, the numeral 10 refers broadly to a frame of metallic sheet material for a conventional jalousie window. The frame is composed of a pair of end frame members 12, 14 and side frame members 16, 18. Each frame member is of channel configuration having respective base panels 20, 22, 24, 26, normal to the plane of the frame, and outwardly extending flanges 28, 30, 32, 34 disposed at least along the outer edges of the base panels, and parallel to the plane of the frame.

In accordance with the invention, each of the base panels 24, 26 of the side frame member 16, 18 have a plurality of equally spaced openings therethrough, each opening in one of the base panels being aligned with an opening in the other of the base panels, these openings being in the positions normally occupied by the pivot supports for the slat brackets. First metallic bars 36 extend transversely across the opening defined by the frame and have end parts 38 which pass though each pair of aligned openings in the base panels of the side frame members 16, 18 and extend beyond the side frame members for embedment in masonry 40 surrounding a window opening in the side of a building as illustrated in FIG. 1.

A pair of second metallic bars 42, 44 are disposed on opposite sides of the frame 10 adjacent and parallel to the side frame members and outwardly of the respective base panels. The second bars are rigidly joined, as by welding, to the extending ends 38 of the first bars 36. Desirably, the second bars 42, 44 are flat and have a plurality of openings therethrough complementary to and corresponding in number and spacing to the respective ends 38 of the first bars 36 which ends pass through the openings in the second bars and are fixed thereto by annular welding 46 as seen in FIG. 2.

Pairs of slat support brackets 48 are pivotally mounted on each of the respective first bars 36, each bracket of a pair being disposed adjacent to and inwardly of the respective side frame members 16, 18. The slat brackets 48 are conventional and at least all brackets on one side of the frame are operated in unison by conventional means, the means illustrated comprising a rearwardly extending arm part 50, integral with each bracket or at least the ones on one side of the frame, and which are pivotally fastened at 52 to a vertically movable rod 54 connected by a link 56 to a conventional crank-operated adjusting mechanism, generally indicated in FIG. 2 by the numeral 58. Those brackets operated by the crank are connected to the brackets on the other side of the frame through the jalousie slats 60, which may be glass, as shown, or they may be of an opaque substance, such as wood, to control both ventilation and shade.

It should be understood that the pair of second bars may be located in any convenient position along the ends of the first bars; that is to say, they can be quite close to the outer side to the base panels of the side members or they can be spaced farther along the ends so that they too can be embedded in the masonry. Preferably all of the bars are of a high grade steel difficult to cut with ordinary tools such as files or hacksaws.

It will be apparent that the invention is susceptible of a variety of changes and modifications without, however, departing from the scope and spirit of the appended claims.

What is claimed is:

1. A security window of the jalousie variety comprising a rectangular frame of metallic sheet material adapted to be received in a complementary window opening of a building, said frame being defined by pairs of side and end frame members, said side frame members including base panels normal to the plane of said frame, each of said base panels having a plurality of longitudinally spaced openings therethrough, each opening in one of said base panels being aligned with an opening in the other of said base panels, a plurality of first metallic bars extending transversely across the opening defined by said frame, each bar having opposed end parts passing through each of a pair of aligned openings in said base panels and extending outwardly beyond said side frame members for embedment in masonry surrounding a window opening, a pair of second metallic bars each parallel to the outer side of a respective side frame member, means rigidly and non-rotatably connecting each of said second bars to the respective extending ends of said first bars, pairs of jalousie slat support brackets pivotally mounted on each of the respective first bars, each bracket of a pair being disposed adjacent to and inwardly of the respective side frame members, and adjusting means interconnecting all of the brackets on at least one side of the frame for simultaneously adjusting to the same degree the angular positions relative to the first bars of all of said brackets on said at least one side of said frame.

2. The security window of claim 1 wherein said second bars are flat, each having a plurality of openings therethrough complementary to and corresponding in number and spacing to the ends of the respective first bars, said ends passing through the openings in said second bars and being rigidly fixed in said openings.

3. The security window of claim 1 including a slat received in each pair of support brackets.

4. The security window of claim 3 wherein said slats are panes of window glass.

5. The security window of claim 1 wherein all of said bars are of steel.

* * * * *